US009629444B2

(12) United States Patent
Isensee

(10) Patent No.: US 9,629,444 B2
(45) Date of Patent: Apr. 25, 2017

(54) MULTI-FUNCTION HABITABLE BACKPACK

(71) Applicant: Sherman Albert Isensee, Las Vegas, NV (US)

(72) Inventor: Sherman Albert Isensee, Las Vegas, NV (US)

( * ) Notice: Subject to any disclaimer, the term of this patent is extended or adjusted under 35 U.S.C. 154(b) by 0 days.

(21) Appl. No.: 14/965,414

(22) Filed: Dec. 10, 2015

(65) Prior Publication Data

US 2016/0100674 A1 Apr. 14, 2016

(51) Int. Cl.

| | |
|---|---|
| ***A45F 4/06*** | (2006.01) |
| ***A45F 4/04*** | (2006.01) |
| ***A45F 3/04*** | (2006.01) |
| ***A45F 3/06*** | (2006.01) |
| *A45F 3/00* | (2006.01) |

(52) U.S. Cl.

CPC ..... *A45F 4/04* (2013.01); *A45F 3/04* (2013.01); *A45F 3/06* (2013.01); *A45F 4/06* (2013.01); *A45F 2003/003* (2013.01); *A45F 2003/045* (2013.01)

(58) Field of Classification Search

CPC ..... A45F 4/00; A45F 4/02; A45F 4/04; A45F 4/06; A45F 4/08; A45F 4/10; A45F 2004/003; A45F 2004/006; A45F 2004/023; A45F 2004/026; A45C 9/00; E04H 15/008; E04H 15/30

USPC ..... 224/153–156, 575, 577, 923, 629, 634; 135/95, 87

See application file for complete search history.

(56) References Cited

U.S. PATENT DOCUMENTS

| | | | | | |
|---|---|---|---|---|---|
| 3,158,299 | A | * | 11/1964 | Weir | A45F 4/02 114/354 |
| 3,918,109 | A | * | 11/1975 | Barraclough | A45F 4/06 135/90 |
| 4,085,873 | A | | 4/1978 | Schweitzer | |
| 4,871,101 | A | * | 10/1989 | Bunz | A45F 4/08 224/153 |
| 4,947,498 | A | * | 8/1990 | Van Boxtel | A45F 4/06 224/155 |
| 5,490,619 | A | | 2/1996 | Boyar | |
| 5,573,166 | A | | 11/1996 | Leja | |
| 6,053,382 | A | | 4/2000 | Wyant | |
| 6,135,333 | A | | 10/2000 | Tucker | |
| 6,179,188 | B1 | | 1/2001 | Gleason | |

(Continued)

*Primary Examiner* — Nathan J Newhouse
*Assistant Examiner* — Scott McNurlen
(74) *Attorney, Agent, or Firm* — Garrett James O'Sullivan

(57) ABSTRACT

A load carrying device with shoulder straps and a waist belt fitted to an outer hull rigid-composite exoskeleton that contains within it, a similar inner rigid-composite hull or hull(s) that are extendable from the outer hull. When the inner hull is retracted inside the outer hull the backpack has a load capacity volume, such that the backpack can be used in an un-extended form as a backpack for carrying materials, such as camping supplies, equipment or mission specific components. Alternatively, when the inner hull is empty, and the inner hull/exoskeleton is extended out from within the outer hull/exoskeleton and mechanically coupled together with the outer hull, the extended backpack can be used as a habitable rigid secure sleeping space, thus providing sheltered protection against predatory animals, environment, reptiles and other environmental hazards within a hard exoskeleton.

9 Claims, 4 Drawing Sheets

LEGEND – FIGURE(S) 2 , 3 AND 4 - IN PRONE POSITION

1 – WAIST BELT

2 – PADED SHOULDER HARNESS

3 – OUTER HULL/EXOSKELETON

4 – FABRIC HULL/EXOSKELETON COVER WITH POCKETS

5 – MUTI-FUNCTION ATTACHMENT RAILS/LEGS

6 – OPTIONAL INTEGRATED ASSESSORY CHARGING SOLAR PANEL

7 – FABRIC STORAGE COMPARTMENT

8 – (SEE ABOVE LEGEND)

9 – COUPLING AXIS FUSION GUSSET CLASP

10 – INNER HULL/EXOSKELETON SLIDE OUT FROM WITHIN OUTER HULL/EXOSKELETON

11 - ACCESS DOOR – HINGED OR SLIDING

11 A – ACCESS DOOR DEPICTED IN CLOSED-PROTECTION POSITION

12 – PERSON LAYING WITHIN

(56) References Cited

U.S. PATENT DOCUMENTS

| | | | | |
|---|---|---|---|---|
| 2002/0020729 | A1* | 2/2002 | Alter | A45C 5/02<br>224/629 |
| 2007/0113338 | A1* | 5/2007 | Remblad | A45F 4/06<br>5/420 |
| 2010/0024710 | A1* | 2/2010 | Malone | B63B 7/04<br>114/353 |
| 2010/0252589 | A1* | 10/2010 | Popescu | A45F 4/02<br>224/155 |
| 2015/0230591 | A1* | 8/2015 | Maybin | A45F 4/10<br>224/153 |

* cited by examiner

LEGEND – FIGURE 1 IN UP-RIGHT LOAD CARRYING POSITION

1 – WAIST BELT

2 – SHOULDER HARNESS

3 – OUTER HULL/EXOSKELETON

4 - FABRIC HULL/EXOSKELETON COVER WITH POCKETS

5 – MULTI-FUNCTION ATTACHMENT RAILS/LEGS

6 – OPTIONAL INTEGRATED ASSESSORY CHARGING SOLAR PANEL

7 – FABRIC STORAGE COMPARTMENT

8 – FABRIC RAIN/DUST COVER/FLAP

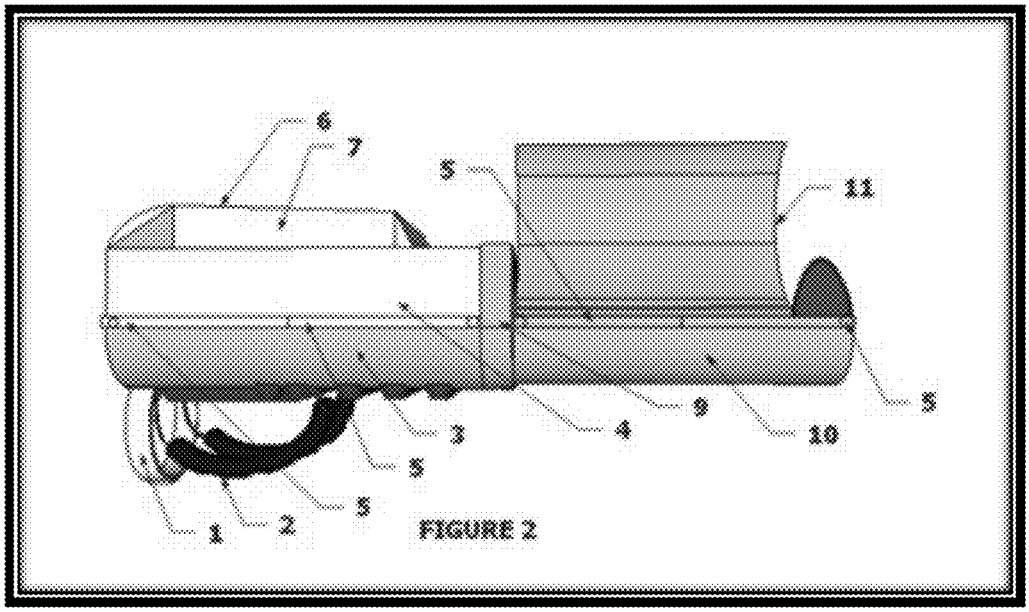

FIGURE 2

LEGEND – FIGURE(S) 2 , 3 AND 4 - IN PRONE POSITION

1 – WAIST BELT

2 – PADED SHOULDER HARNESS

3 – OUTER HULL/EXOSKELETON

4 – FABRIC HULL/EXOSKELETON COVER WITH POCKETS

5 – MUTI-FUNCTION ATTACHMENT RAILS/LEGS

6 – OPTIONAL INTEGRATED ASSESSORY CHARGING SOLAR PANEL

7 – FABRIC STORAGE COMPARTMENT

8 – (SEE ABOVE LEGEND)

9 – COUPLING AXIS FUSION GUSSET CLASP

10 – INNER HULL/EXOSKELETON SLIDE OUT FROM WITHIN OUTER HULL/EXOSKELETON

11 – ACCESS DOOR – HINGED OR SLIDING

11 A – ACCESS DOOR DEPICTED IN CLOSED-PROTECTION POSITION

12 – PERSON LAYING WITHIN

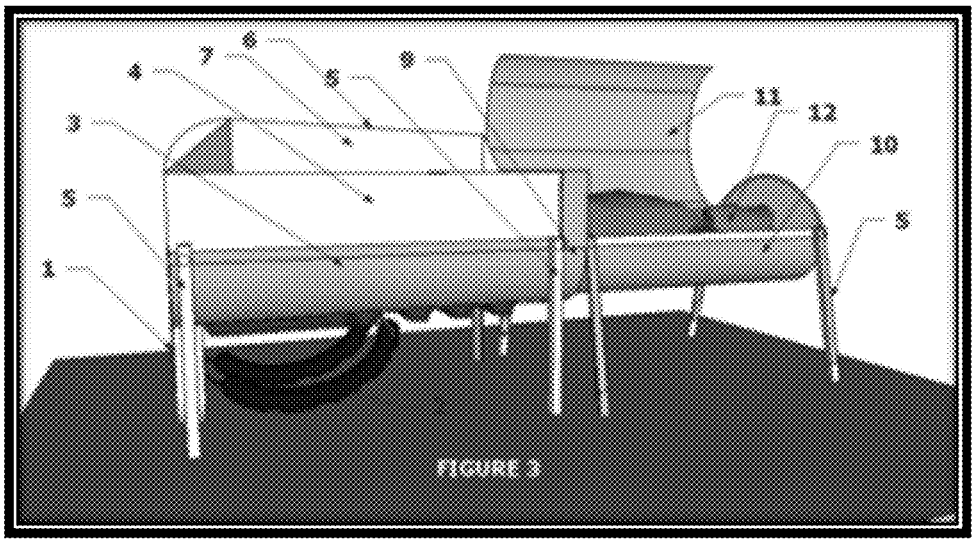

LEGEND – FIGURE(S) 2 , 3 AND 4 - IN PRONE POSITION

1 – WAIST BELT

2 – PADED SHOULDER HARNESS

3 – OUTER HULL/EXOSKELETON

4 – FABRIC HULL/EXOSKELETON COVER WITH POCKETS

5 – MUTI-FUNCTION ATTACHMENT RAILS/LEGS

6 – OPTIONAL INTEGRATED ASSESSORY CHARGING SOLAR PANEL

7 – FABRIC STORAGE COMPARTMENT

8 – (SEE ABOVE LEGEND)

9 – COUPLING AXIS FUSION GUSSET CLASP

10 – INNER HULL/EXOSKELETON SLIDE OUT FROM WITHIN OUTER HULL/EXOSKELETON

11 – ACCESS DOOR – HINGED OR SLIDING

11 A – ACCESS DOOR DEPICTED IN CLOSED-PROTECTION POSITION

12 – PERSON LAYING WITHIN

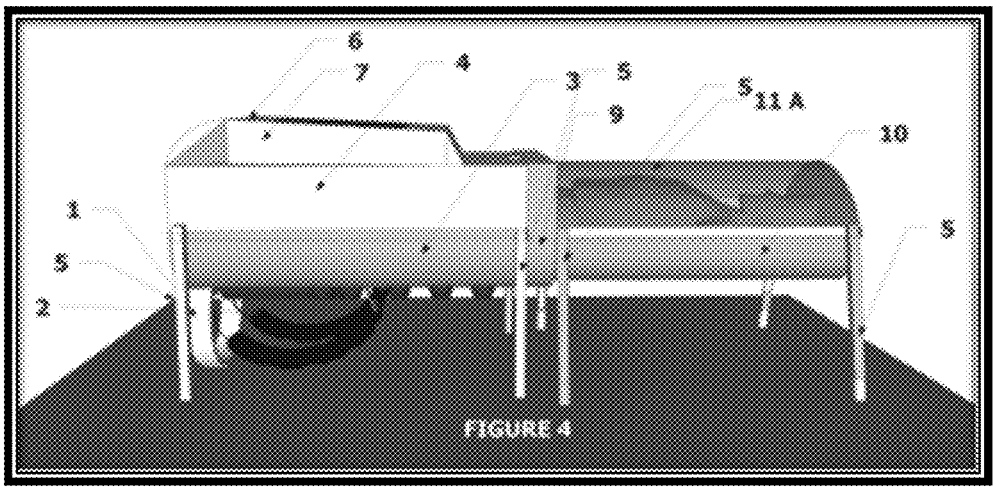

FIGURE 4

LEGEND – FIGURE(S) 2 , 3 AND 4 - IN PRONE POSITION

1 – WAIST BELT

2 – PADED SHOULDER HARNESS

3 – OUTER HULL/EXOSKELETON

4 – FABRIC HULL/EXOSKELETON COVER WITH POCKETS

5 – MUTI-FUNCTION ATTACHMENT RAILS/LEGS

6 – OPTIONAL INTEGRATED ASSESSORY CHARGING SOLAR PANEL

7 – FABRIC STORAGE COMPARTMENT

8 – (SEE ABOVE LEGEND)

9 – COUPLING AXIS FUSION GUSSET CLASP

10 – INNER HULL/EXOSKELETON SLIDE OUT FROM WITHIN OUTER HULL/EXOSKELETON

11 – ACCESS DOOR – HINGED OR SLIDING

11 A – ACCESS DOOR DEPICTED IN CLOSED-PROTECTION POSITION

12 – PERSON LAYING WITHIN

MULTI-FUNCTION HABITABLE BACKPACK

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

The present invention relates to backpacks. In particular, the present invention relates to a backpack for use in holding and transporting clothing, miscellaneous equipment, and various gear for outdoor recreation or other activity wherein a need exists for a device which can be used comfortably to haul a range of lesser or greater and varying loads. The use of backpacks is known and widely established. An example of a "standard" backpack is disclosed in U.S. Pat. No. 4,085,873 to Schweitzer. The variety and extent of backpacks extend from small and lightweight daypacks such as the one disclosed in U.S. Pat. No. 5,573,166 to Leja, to larger and heavier duty backpacks such as that disclosed in U.S. Pat. No. 6,179,188 to Gleason. While there are many exceptional and useful backpacks in the prior art, it is in general a fact that they are fairly uniform in their individual purposes. For example, it wouldn't be practical to use a small daypack as a personal protective sleeping habitat on a camping trip, just as it is impractical to use a large and bulky expeditionary backpack as a personal protective sleeping habitat. Yet with the advancement of protective species acts and the related proliferation of predatory mammals such as bears and wolves and in instances of a predatory animals not having fear of human interaction, there are activities in which it is desirable to have a single backpack, which is generally compact, but which has the built-in potential to also function as a protective habitat as a barrier. In the example of the activity backpacking in the outdoors, there is a common desire for a load packing device of sufficient volume for hauling necessities for a prolonged outing, as well as a common desire to minimize the hazards when sleeping in the outdoors from ambush of that of predatory animals and from dangerous insects, reptiles and other environmental hazards. Many such stories exist where a sleeping outdoor camper finds themselves being attacked or fed upon and killed by bear or other predatory animal while sleeping. Such a protected sleep barrier is not typically suited to the carriage of quantities of loads on the back where the backpack form has the versatility to be transformed from one form into the other.

There are diverse examples in the prior art of backpacks which are devised for the carriage of meat, and others that alter configuration or load volume in some fashion. U.S. Pat. No. 6,135,333 to Tucker, et al. discloses a meat carrying backpack, but it can be seen that it doesn't fulfill the need of a protective occupy-able habitat for purposes of protective sleep. As disclosed in U.S. Pat. No. 5,490,619 to Boyar, the prior art contains examples of backpacks which are devised to be transformed into existence from out of another form, in this case a purse, but this dearly wouldn't be suitable for the purpose described herein. In U.S. Pat. No. 6,053,382 to Wyant, an expansion gusset is disclosed, which is an example of a means of expanding the volumetric carrying capacity of a specific compartment within a backpack. In this case, however, the change in dimension that is affected is not significant enough to be of use as an occupancy habitat.

Other designs exist which comprise efforts to have a backpack with a flexible load carrying volume. These however pertain to load carrying and are not pertaining to the purposes of a combination expanded sleeping refuge form and an un-expanded form for load carrying. Some are fitted with laced drawstrings or adjustable straps which can compress the cargo space of a pack into its most diminished form. These are excellent in their place, and some may be of use to a camper, but nonetheless it is generally true that these backpacks do not significantly after their form, and do not significantly have the capacity to increase their volume. If they are large enough to be of use in hauling larger things, they do not deploy so sufficiently to occupy and also do not compress sufficiently for use as a backpack.

While backpacks similar to those in the prior art have somewhat fulfilled the transportation and storage requirements of outdoorsmen to date, there exists a need to have backpacks which have better and more convenient deployable additional capability, and offer a greater range of versatility than prior art backpacks. In particular, with a greater and more widely prevalent emphasis on adventure, personal fitness, and personal mobility, many hunters, campers, outdoorsmen and outdoor adventurers are traveling great distances on their feet. In the example of such an activity, there is an incumbent need to also have a level of protection in the outdoors from the natural predatory instincts of predatory animals, and from other environmental risks. It is submitted that the present invention substantially meets these needs.

BRIEF SUMMARY OF THE INVENTION

The backpack of the present invention is devised such that it can be used in an un-expanded form for strapped on the back carriage of loads such as portable camping equipment and supplies or mission specific components, or in expanded form when emptied of contents to occupy within for purposes of protected sleep. In the specific example of camping, a user will depart for an outdoor outing of a night or more with all the basic necessities for the duration of the outing stored in the primary storage compartment(s) of said backpack, and when subsequently it comes time to stop and camp for the night, the backpack when emptied of contents can be deployed into its expanded form to occupy within for purposes of a protective barrier during sleep, wherein it retains full use when not occupied in un-expanded form of the basic strapped on the back carriage of loads. In an alternative example, the pack can be used in its un-expanded form to travel with a full complement of camping or traveling gear, which can be subsequently unloaded, thereby allowing the pack to be transformed into its expanded form for use as a personal protective barrier to sleep within.

More particularly, the backpack of the present invention includes a releasable division between one or more primary compartments that, when released, allows the inner hull/hull(s)/exoskeleton storage compartment(s) to slide outwardly from inside the outer hull/exoskeleton and back into again, in thus doing in expanding the inner hull/hull(s)/ exoskeleton from the outer hull/exoskeleton that can then be utilized for a person to occupy and lay within, or thus when un-expanded can be utilized for a shoulder strapped load carrying device. The backpack is fully functional and convenient for use in either it's compacted or expanded embodiments.

The habitable backpack according to the present invention substantially departs from the conventional concepts and designs of the prior art, and in so doing provides an apparatus which functions well as a backpack of the prior art, but which can readily be converted or transformed into a space sufficiently to occupy as a protective habitat.

BRIEF DESCRIPTION OF DRAWINGS

FIG. 2 is an elevated prone right front view of the invention, showing it in its expanded form.

FIG. 3 is an elevated right prone plan view, showing the invention in its expanded form with an access aperture and the division between the outer hull and the inner hull/hulls or exoskeleton compartments as an example of its unique embodiment, as an occupy-able habitat.

FIG. 4 is an elevated right prone view, showing same as FIG. 4 with the access aperture closed in its unique embodiment, as a secure protective habitat.

DETAILED DESCRIPTION OF THE INVENTION

Figure 1:
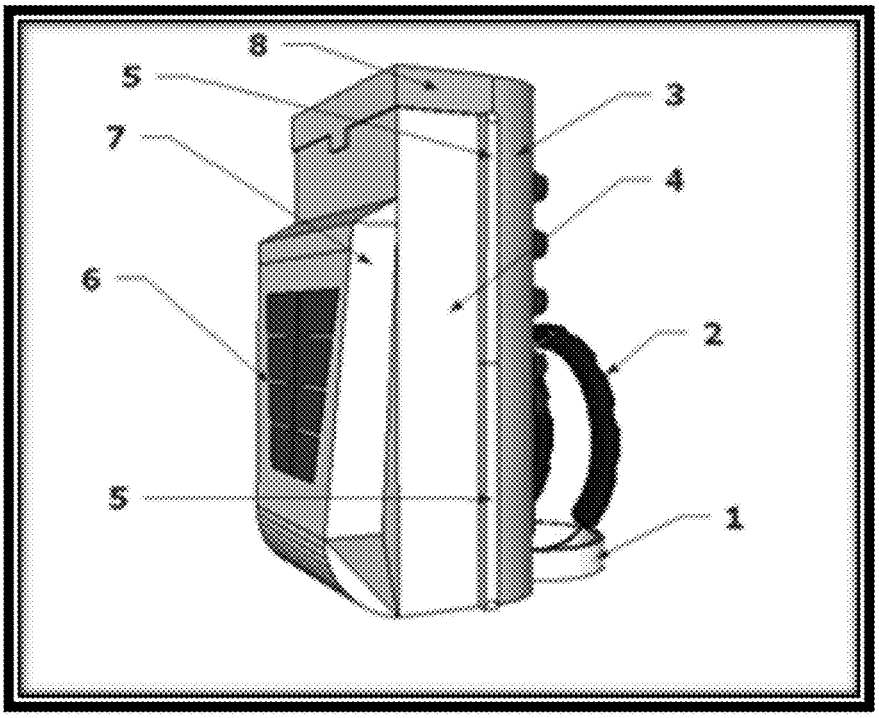
FIG. 1 is an elevated right back quartering view of the invention, showing it in its un-expanded form.

In accordance with the present invention, a backpack is provided, which is similar in styling to other backpacks designed for outdoor use, which is durable, only with rigid outer hull/exoskeleton and inner hull/hull(s) that store within the outer hull/exoskeleton and which has both un-expanded and expanded forms. In its primary, compacted form, as shown in FIG. 1, it is similar in size and proportion to what is commonly called a backpack. In its secondary, expanded form, as shown in FIG. 2, it has greater volumetric capacity, and can be used for a person to occupy within. In particular, the backpack of the present invention includes a waist belt 1, with two shoulder harnesses 2, an outer main hull/exoskeleton 3, and fabric cover that is suitable for mission/use specifics, such as mosquito and insect protective barrier, or non-ventilated with insulating or ballistic resistance or weather resistance or fire resistance characteristics or in combinations thereof of nylon or other with expansiveness sufficient to cocoon over the hull(s)/exoskeleton(s) with separate enclosed storage compartments and expansive 4, multifunction rails that can also be used as legs or customizable rails customizable mission specifics 5, an optional flexible solar charging panel option 6, additional fabric storage compartment 7, with fabric cover flap for access to load contents 8, and gusset fusion mechanical clasp where the outer hull/exoskeleton releasable attach to the inner hull/hull(s) to the another, thereby in attached combination form a single elongated/expanded form of rigidity for purposes of to occupy within 9, inner hull/hull(s)/exoskeleton in its pulled out from inside the outer hull/exoskeleton in its expanded form 10, an access aperture/door/hatch/panel for occupy-able access purposes 11, and the same access aperture/door/hatch/panel in its closed position 11*a*, and a person laying within in its expanded occupy-able form 12. Preferably the backpack is composed mainly of a high strength, lightweight rigid hull/hull(s)/exoskeleton(s) with nylon fabric cover, although any suitable fabric cover materials or other materials may be used. Also in a preferred embodiment, the primary inner hull/hull(s) storage compartment of the backpack configuration are subdivided internally into several separate cells, each of which can be individually accessed via a zippered or similarly provided aperture and which cell separators are also removable and when removed can be assembled into various components.

More specifically, the construction of the backpack is as follows. The main outer hull/exoskeleton 3, separates the inner hull/hull(s)/exoskeleton(s) and the various storage compartments from the wearer's back, is generally rectangular in shape, and may be padded or webbed where it will be in direct contact with the wearer's back and is attached to two padded shoulder straps 2, adjustable for length, and of a typical fashion that is widely known to the prior art, are attached to the rear 3 of the main outer hull/exoskeleton to facilitate wearing about the shoulders of a user. A hip or waist belt 1, which also is well known to the art, may or may not be alternatively provided. On the outward edges 3 of the front side of the outer hull/exoskeleton, pocket fabric storage compartments 7 are fixedly attached to the outer hull/exoskeleton's fabric cover 3. These storage compartments are made of nylon or other fabric material. In the present embodiment, these storage compartments are fitted with a top flap 8 with releasable and adjustable closure. Any similar contrivances that perform the same functions for access to the interior of the compartments may be used. The said primary outer hull/exoskeleton 3, and the inner hull/hull(s)/exoskeleton(s) 10, are release-ably attached to each other along the edge of the extension(s) 9 when deployed in the expanded form.

The drawings and the present description of the invention are illustrative only, for purposes of explaining and disclosing the invention. Since numerous modifications and changes will readily occur to those skilled in the art, it is not desired to limit the invention to the exact construction shown and described, and accordingly all modifications and equivalents may be regarded as falling within the scope of the invention. Other forms that employ the present invention and serve the purposes described herein are meant to be encompassed by this disclosure.

I claim:

1. A multi-function habitable backpack comprising:

a. an open top outer hull having two sides, a front, a back, and a bottom, the outer hull comprising:
   i. a web panel;
   ii. two shoulder straps; and
   iii. a padded waist belt, wherein the web panel, the shoulder straps, and the padded waist belt extend outward from an outer surface of the back of the outer hull; and b. an open bottom inner hull having two sides, a front, a back and a top; and c. a top flap, wherein in the closed position, the top flap closes to encapsulate the inner hull within the outer hull, wherein the inner hull and the outer hull are constructed of a rigid material, wherein in a closed position, the inner hull is disposed within the outer hull, and in an extended position, the inner hull is pulled out from the outer hull, wherein in the extended position the outer hull and inner hull form an interior space of the backpack sufficient for a person to lay within.

2. The backpack of claim 1, wherein the front of the inner hull comprises an access panel.

3. The backpack of claim 2, wherein the access panel is a hinged or sliding access door.

4. The backpack of claim 1, wherein in the extended position, the outer hull is mechanically coupled to the inner hull.

5. The backpack of claim 4, further comprising outer rails and inner rails, said outer rails being rotatably connected to an outer surface of the outer hull and said inner rails being rotatably connected to an outer surface of the inner hull, wherein the rails serve as legs for the backpack.

6. The backpack of claim 1, wherein the inner hull comprises one or more storage compartments.

7. The backpack of claim 1, further comprising a fabric exterior cover.

8. The backpack of claim 7, wherein the fabric exterior cover is water resistant, and wherein the fabric exterior cover comprises integral storage compartments and an aperture formed at or near the top to permit access to the backpack.

9. The backpack of claim 7, wherein the fabric exterior cover is anti-ballistic, the fabric exterior cover comprising:

a. integral storage compartments; and b. an aperture formed at or near a top of the cover to permit access to the backpack.

* * * * *